United States Patent [19]

Broadhead et al.

[11] Patent Number: 4,541,671

[45] Date of Patent: Sep. 17, 1985

[54] PATIENT SUPPORT

[75] Inventors: James H. Broadhead; Lawrence A. Wilbur; Ivan E. Sams, all of Bay Minette, Ala.

[73] Assignee: Syntex (U.S.A.) Inc., Palo Alto, Calif.

[21] Appl. No.: 439,657

[22] Filed: Nov. 5, 1982

[51] Int. Cl.[4] ..... A47C 1/02

[52] U.S. Cl. ..... 297/330; 297/68; 297/71; 297/83

[58] Field of Search ..... 297/330, 68, 71, 83, 297/84, 85, 86, 87

[56] References Cited

U.S. PATENT DOCUMENTS

| | | | |
|---|---|---|---|
| 3,025,108 | 3/1962 | Teague, Jr. | 297/330 |
| 3,172,699 | 3/1965 | Naughton | 297/330 X |
| 3,223,448 | 12/1965 | Naughton | 297/418 |
| 3,414,324 | 12/1968 | Taylor et al. | 297/90 |
| 3,578,379 | 5/1971 | Taylor et al. | 297/330 |
| 3,774,965 | 11/1973 | Brandt et al. | 297/417 |
| 3,924,894 | 12/1975 | Rabinowitz et al. | 297/460 |
| 3,934,929 | 1/1976 | Rabinowitz | 297/75 |
| 4,017,118 | 4/1977 | Cawley | 297/284 |
| 4,065,182 | 12/1977 | Braniff | 297/455 X |
| 4,173,372 | 11/1979 | Norris | 297/345 |
| 4,379,588 | 4/1983 | Speice | 297/330 |

FOREIGN PATENT DOCUMENTS

| | | | |
|---|---|---|---|
| 8415 | 3/1980 | European Pat. Off. . | |
| 2028007 | 12/1971 | Fed. Rep. of Germany . | |
| 2157291 | 1/1973 | Fed. Rep. of Germany . | |
| 2418524 | 10/1974 | Fed. Rep. of Germany . | |
| 2340605 | 2/1975 | Fed. Rep. of Germany . | |
| 2501754 | 7/1975 | Fed. Rep. of Germany . | |
| 8034604 | 5/1981 | Fed. Rep. of Germany . | |
| 3209773 | 9/1983 | Fed. Rep. of Germany . | |
| 2178880 | 11/1973 | France . | |
| 2239983 | 3/1975 | France . | |
| 66397 | 12/1912 | Switzerland | 297/68 |
| 537872 | 7/1941 | United Kingdom . | |
| 1041365 | 9/1966 | United Kingdom . | |
| 1063614 | 3/1967 | United Kingdom . | |
| 2037579 | 7/1980 | United Kingdom . | |

*Primary Examiner*—James T. McCall

*Attorney, Agent, or Firm*—Derek P. Freyberg; David A. Lowin

[57] ABSTRACT

A patient support is disclosed having a contoured upper body support with an integral lumbar support area. The lower body support is curved at the knee and likewise contoured for patient comfort. The upper body support is pivotally attached to the lower body support at a point simulating the pivotal location of the human hip. A drive linkage raises the toe area of the lower body support simultaneously with, but only for the initial reclining movement of the upper body support, maintaining the oral cavity in fixed relation to the head support. Arm supports are upwardly rotatable from a down, locked position to an up, unlocked position. The patient support has automatic recline and sit-up mechanisms with emergency stop circuitry.

15 Claims, 18 Drawing Figures

FIG. 12
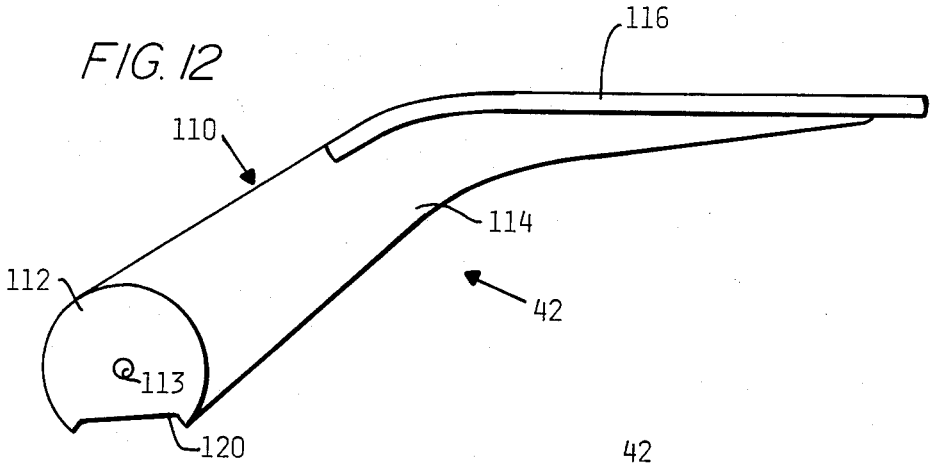
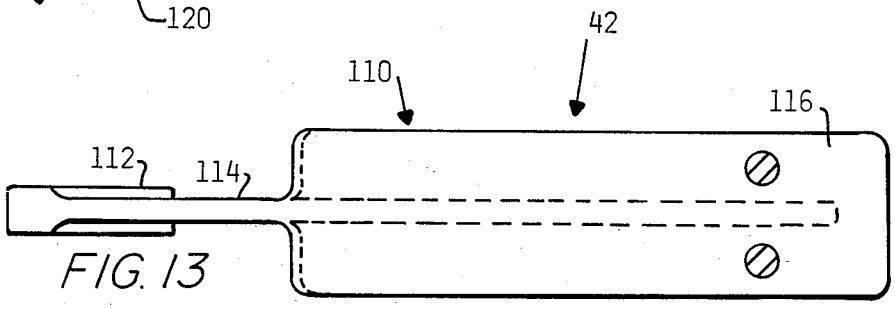
FIG. 13
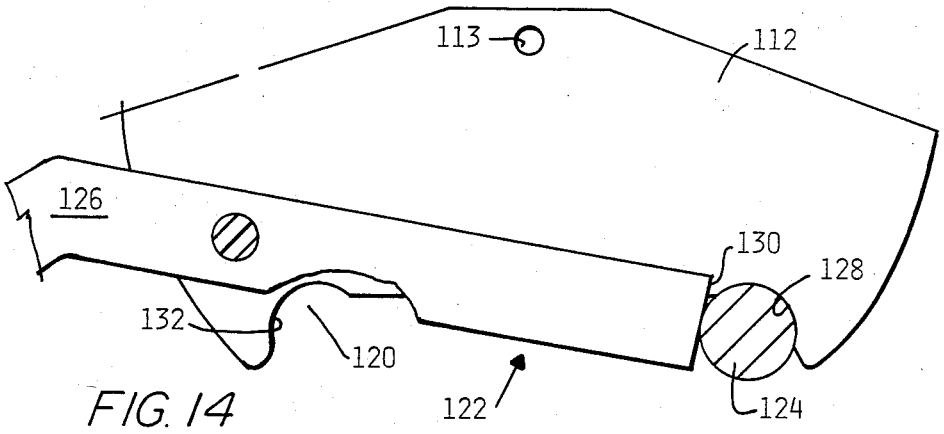
FIG. 14

PATIENT SUPPORT

BACKGROUND OF THE INVENTION

The present invention relates to the field of patient supports, more particularly to an adjustable chair for use in dental operatories and other medical examination rooms.

There are three principal attributes which must be addressed in the design of a patient support, particularly one that is used in a dental operatory, namely, aesthetic appeal, functionality, and economy. Aesthetics are particularly important in the dental operatory setting, where the patients remain clothed while being treated. This requires a more plush environment than a standard clinical examination room, for the psychological comfort of the patient. The dental operatory must, therefore, maintain the appearance of a warm room with furniture, rather than that of a cold examination room. The patient support must appear to be stylish, comfortable, and modern in order to calm the patient and to enhance the professional appearance of the dentist.

Functionality in a patient support entails its being easily adjustable, in order to orient the area being worked on at an optimum position for the work being done. It must be sturdy enough to support a variety of body sizes and shapes while remaining comfortable and adjustable for all patients. The patient support must be easy to enter and exit. Another characteristic of a desirable patient support is its ride, the sensation experienced by a patient while the chair is being reclined to an operating position and returned to a fully upright position. The ride must be smooth and should preferably be designed to keep the patient securely seated in the chair, maintaining the oral cavity in the same position with respect to the head support, regardless of where the chair is adjusted to.

Finally, as with all consumer products, it is desirable to meet all the sought-after attributes of a product while keeping it easy to manufacture and inexpensive to produce and sell, giving its manufacturer a greater advantage in the marketplace.

One problem that has existed in previous patient supports has been providing easily operable means for moving an arm rest out of the way to allow easy entrance and exit. Heretofore, various camlock, pushing, pulling, and even release mechanisms for completely removing the arm support have been proposed for solving this problem. Each of the previous mechanisms has been cumbersome to operate as well as prone to accidental movement while a procedure is being performed. It is, therefore, desired to provide an arm movement mechanism that is easy to operate yet remains locked firmly in place while a procedure is being performed, preventing jerk-type reactions by the patient from releasing the arm support.

Another problem in patient supports of the prior art has been a tendency for movement of the oral cavity with respect to the head support member during adjustment of the patient support. In the past, a patient's head would typically slide downwardly along the back member, away from the optimum point of support by the headrest, while the chair was being reclined. This also tended to pull on the patient's clothing. It has surprisingly been discovered that by carefully adjusting the point of pivotal connection of the backrest to the seat member, this objectional head travel and clothing pull can be entirely eliminated, thereby allowing the dentist to position a patient's head on the headrest and then recline the patient support to an operating position without having to readjust the headrest. It is far easier to adjust a headrest when the chair is up in a seated position and the weight of a patient is not concentrated downward on the headrest than it is to make such adjustments once the chair has been reclined.

Another problem that has remained unsolved until the present invention was a failure to recognize the impact on patient support and comfort from the shifting of the center of gravity of the human body when traveling from a seated to a reclined position. Namely, when in a seated position, the majority of the body's weight is oriented downwardly along a line extending from the shoulders toward the bottom of the buttocks. When reclined, however, the force of gravity tends to pull downwardly along the line extending from the front of the chest to the back. Patient supports in the past have operated by elevating the legs, often about a pivotal connection near the knees, in order to make the patient more comfortable when reclining. Fixed-knee patient supports have not accommodated for the change of gravitational pull whatsoever. It has been surprisingly discovered that a greater sense of security and a smoother ride can be accomplished by adjusting the seat angle upwardly as the back support reclines during the beginning of the reclining motion.

The advent of advanced electronic circuitry has permitted the design of patient supports with pre-programmed adjustability. In other words, it has become possible to pre-program the most desired position for beginning examination into the circuitry of a dental chair, so that a single button can be pushed on the chair in order to activate automatic reclining mechanisms to move it to that desired position. Similarly, pre-programmed return-to-exit circuitry is available. This has caused a potential for damage to the equipment in operatories which may be positioned behind or below the patient support, by the patient support crashing down on such equipment while being automatically moved. It has, in the past, been particularly difficult for an operator to reach the proper control switch quickly enough to prevent damage upon noticing that the chair is about to do damage. It is, therefore, desired to provide circuitry to halt the automatic recline or return of a dental patient support by movement of almost any of the other control switches in any of their operating directions. This would provide added safety.

Heretofore, extra heavy cushions have been required to provide a comfortable feeling to the patient, especially if contouring is desired to keep a patient centered in the seat. The bulkiness of such cushions has taken away from the aesthetic appearance of patient supports in the past, rendering them quite bulky and clumsy in appearance. It is desired to provide a patient support which remains thin and appealing to the eye while remaining comfortable to sit in and tending to keep the patient centered. It is further desired to provide integral lumbar support for patients.

Finally, replaceability of the cushions on dental chairs is a desirable feature, to allow the dentist to change decorating schemes without having to completely replace an otherwise useful chair.

OBJECTS OF THE INVENTION

An object of the present invention is to provide a patient support with an armrest that moves out of the way for entry and exit, but, remains securely locked down when the patient support is in use.

Another object of the invention is to provide a patient support where the oral cavity of a patient remains fixed in position relative to the head support, regardless of reclining the back support.

Still another object of the invention is to provide a patient support that does not pull on the clothing of a patient while it is being adjusted.

A still further object of the invention is to provide a patient support having an extremely comfortable ride, wherein the center of gravity of the patient is rotated to the patient's back during the initial moments of reclining.

Another object of the invention is to provide a patient support having easily replaceable cushions.

Yet another object of the invention is to provide a patient support which provides integral lumbar support to the patient's back and is contoured to center the patient in both the back and the seat.

Still another object of the invention is to provide a patient support having arm slings which retain the elbows of the patient closely to the body, and further away from the dentist's working area than was possible before.

Another object of the invention is to provide emergency stop circuitry for halting the automatic motion of a patient support.

Yet another object of the invention is to provide a patient support that satisfys all the foregoing objects while remaining easy to manufacture and economic to purchase.

SUMMARY OF THE INVENTION

A patient support has a contoured upper body support with an integral lumbar support area. The lower body support is curved at the knee and is likewise contoured for patient comfort. The upper body support is pivotally attached to the lower body support at a point simulating the pivotal location of the human hip. A drive linkage raises the toe area of the lower body support simultaneously with, but only for the initial reclining movement of, the upper body support, maintaining the oral cavity in fixed relation to the head support. Arm supports are upwardly rotatable from a down, locked position to an up, unlocked position. The patient support has automatic recline and sit-up mechanisms with emergency stop circuitry.

DESCRIPTION OF THE DRAWINGS

In the drawings:

FIG. 12 is a side elevational view of an arm support casting for a patient, support embodying the principles of the present invention;

FIG. 13 is a top view of the casting of FIG. 12;

FIG. 14 is an enlarged sectional view of a pivotal connecting and locking portion of the casting of FIG. 12;

DETAILED DESCRIPTION OF THE INVENTION

Figure 2:
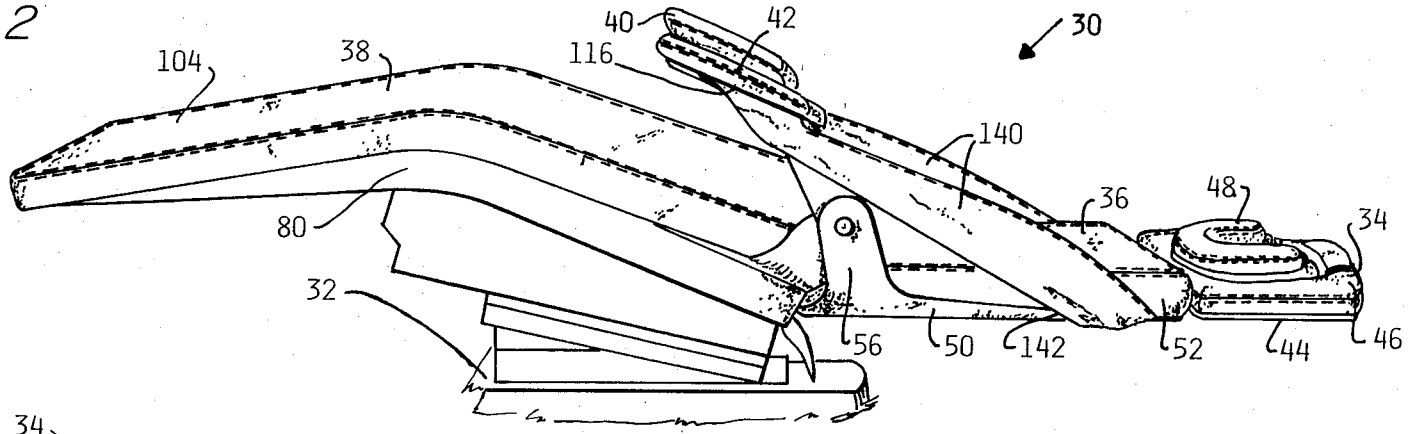
FIG. 2 is a side elevational view of a patient support, shown in the fully reclined position, embodying the principles of the present invention.
Figure 1:
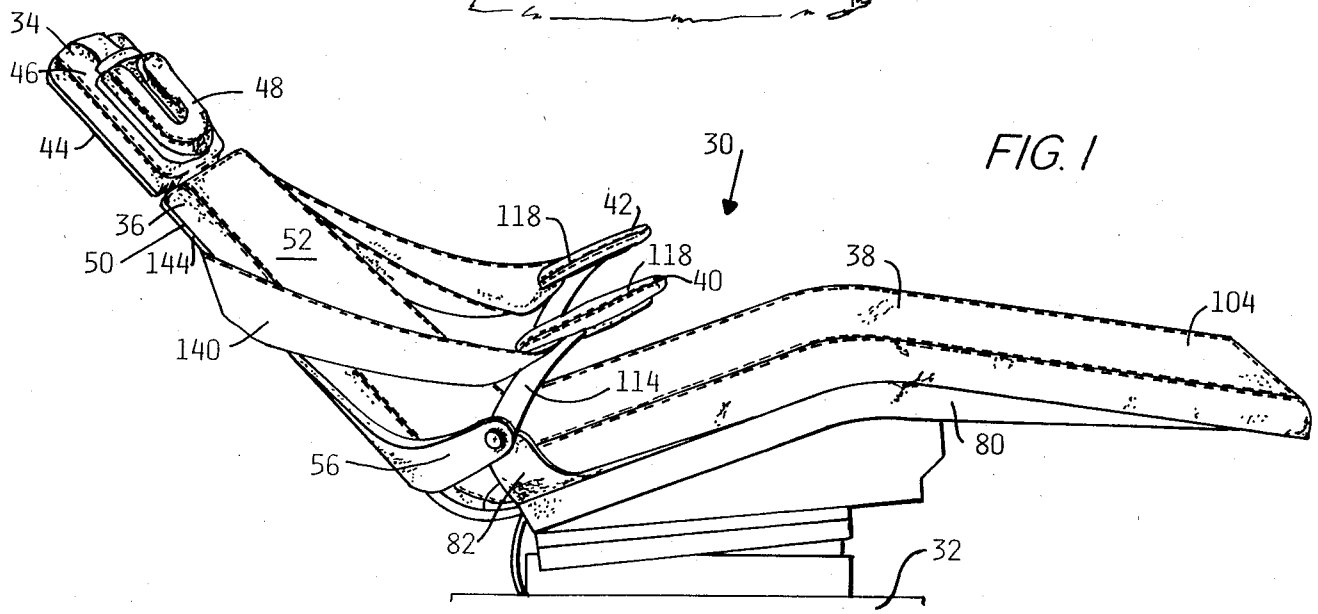
FIG. 1 is a side elevational view of a patient support, shown in the fully upright position, illustrating the present invention.
Figure 4:
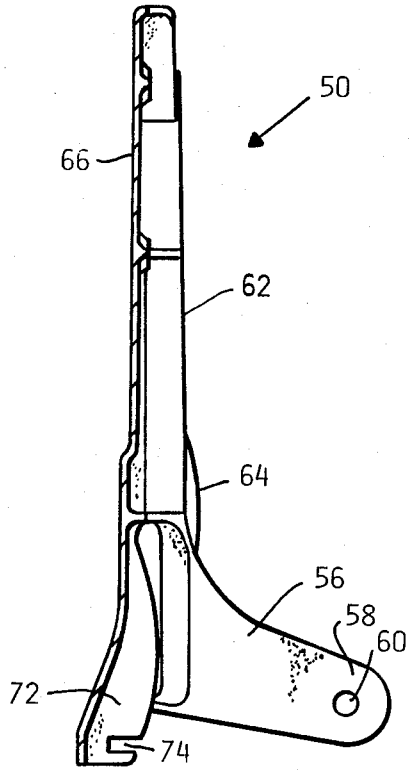
FIG. 4 is a side sectional view of the casting of FIG. 3, taken along line 4—4 in FIG. 3.
Figure 3:
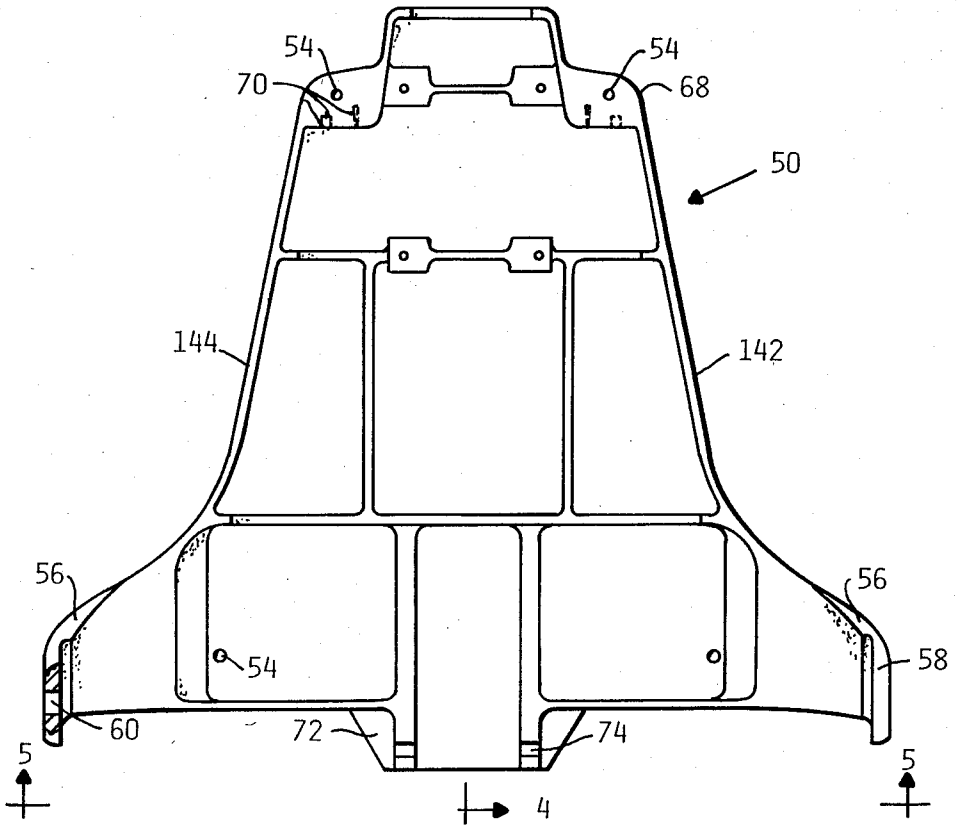
FIG. 3 is a front elevational view of a back support casting for a patient support, embodying the principles of the present invention.

A patient support 30 embodying the principles of the present invention is shown mounted atop a base 32 in an upright position for patient entry and exit, as illustrated in FIG. 1, and in a reclined position for patient treatment, as illustrated in FIG. 2. The patient support has a head support member 34 adjustably received by a back support member 36, which is pivotally attached to a lower body support member 38 together with a pair of arm support members 40 and 42.

The head support member 34 has a head support casting 44 with a cushion 46 mounted thereon. A head supporting pillow 48 may be used in conjunction with the head support member 34.

Figure 5:
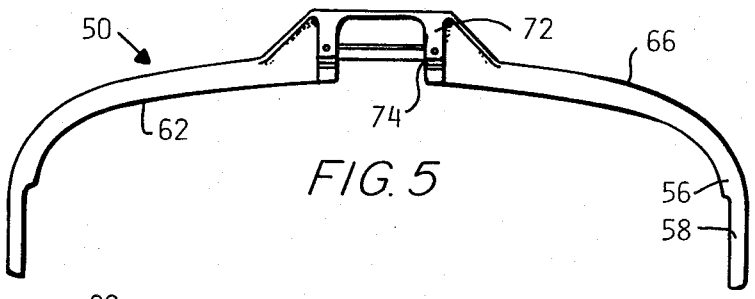
FIG. 5 is a top sectional view of the casting of FIG. 3, taken along line 5—5 in FIG. 3.
Figure 6:
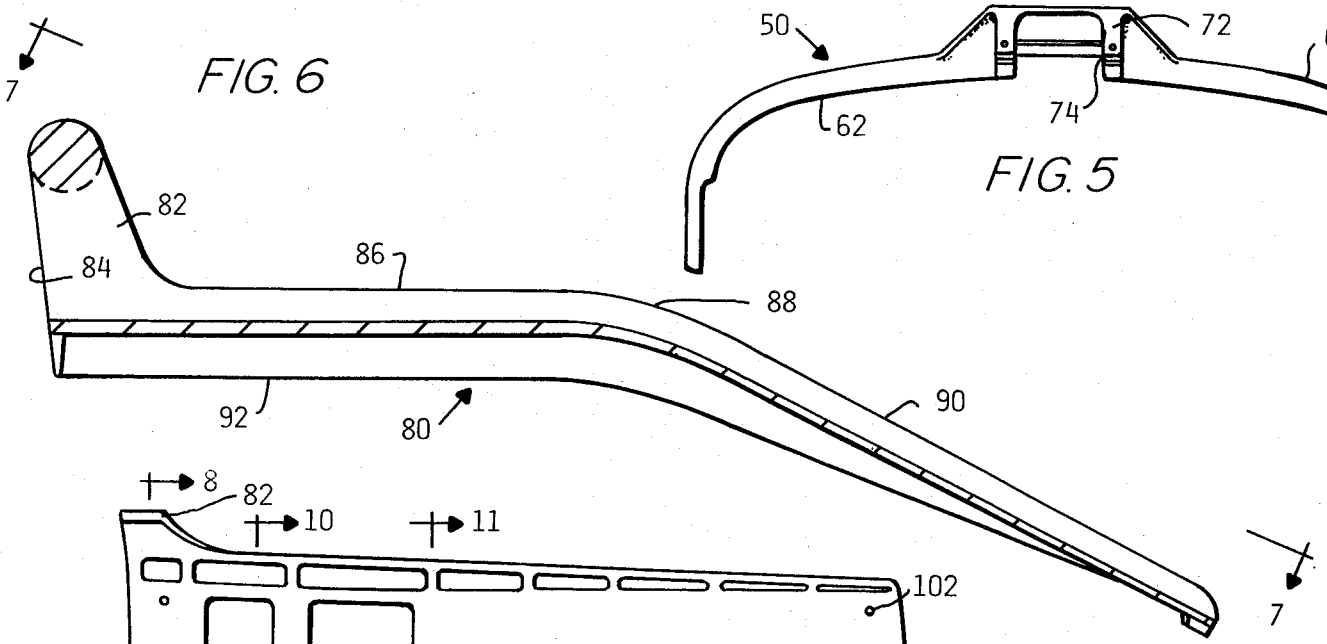
FIG. 6 is a side sectional view of a lower body support casting for a patient support embodying the principles of the present invention, taken along line 6—6 in FIG. 7.
Figure 7:
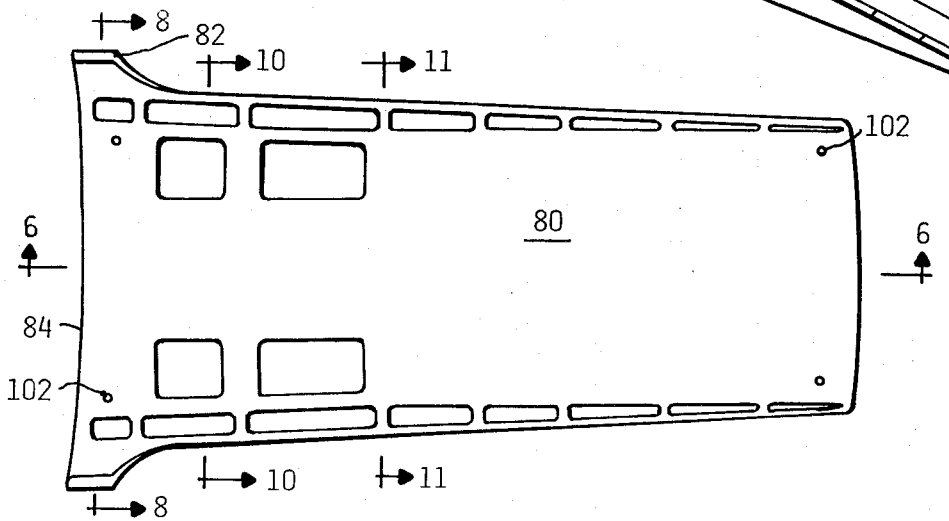
FIG. 7 is top view of the casting of FIG. 6.
Figure 8:
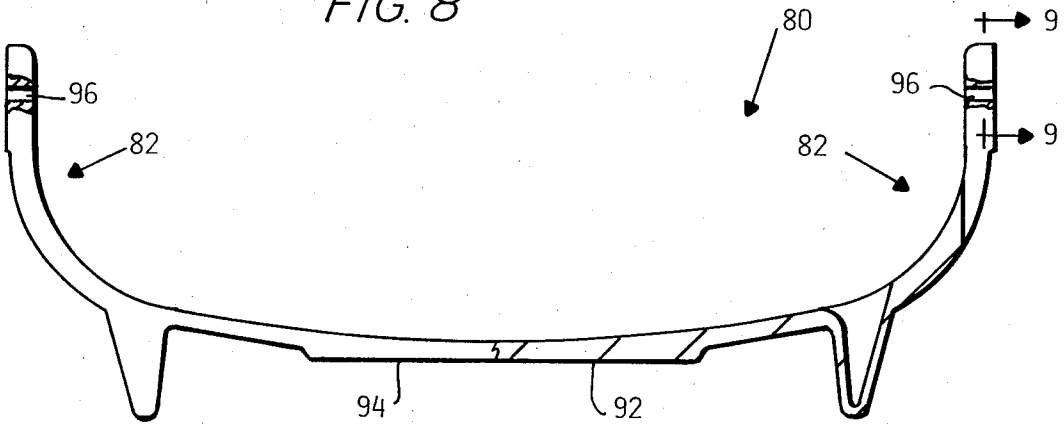
FIG. 8 is a sectional view of the casting of FIG. 6, taken along line 8—8 in FIG. 7.
Figure 9:
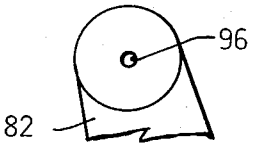
FIG. 9 is a side elevational view of a section of a pivotal connecting portion of the casting of FIG. 6, taken along line 9—9 in FIG. 8.
Figure 10:
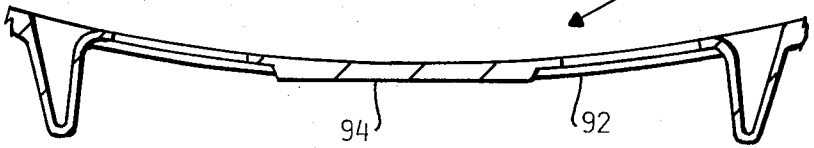
FIG. 10 is a sectional view of the casting of FIG. 6, taken along line 10—10 in FIG. 7.
Figure 11:
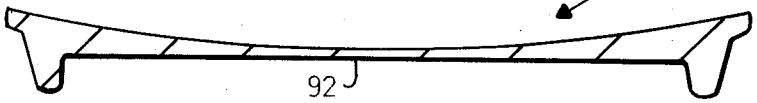
FIG. 11 is a sectional view of the casting of FIG. 6, taken along line 11—11 in FIG. 7.

As illustrated in FIGS. 2, 3, 4 and 5, the back support member 36 has a back support casting 50 with a back support cushion 52 mountable thereon by a plurality of securing elements, such as screws, bolts, nails, or adhesive (not shown). A plurality of openings 54 are provided through back support casting 50 for receiving non-adhesive securing elements. The back support casting has a narrowed top portion and gradually widens toward a pair of outwardly, forwardly curved projections 56 extending approximately 5 inches from the bottom. A pivotal connection portion 58 having an opening 60 is disposed at the end of the projections 56. A front surface 62 of the back support casting is concavely curved to receive the back of the patient firmly at the center of the patient support, as best illustrated in FIG. 5. The back support casting 50 has, at about its lower third, an outwardly curved portion 64 (see FIG. 4) for providing lumbar support to the back of a patient. This combination of concave curvature with a convex portion for the lumbar area permits use of a thin back support cushion, much thinner than those which were employed in the past. Use of this thinner cushion gives the patient support a slimmer, more modern appearance. It also reduces cost and facilitates easy, economical replacement of the cushions. A back surface 66 of contoured back support casting 50 has two recessed areas 68 for the location of controls 70 for adjustment of the patient support. This keeps the control switch out of the way of the dentist, preventing accidental movement of the patient support. The back surface 66 also has a bottom, drive link-receiving portion 72, with a slot 74 for receiving the end of a drive mechanism (to be described later with reference to FIGS. 15 and 16).

The lower body supporting member 38, as illustrated in FIGS. 6–11, has a contoured casting 80 having an upwardly curved pivotal connecting portion 82 with a pivotal connection opening 96 at its back end 84 (see FIG. 8), an angled mid-portion 86 (disposed at about 15–20 degrees upwardly relative to the plane of the floor when the patient support is in the fully upright position), a curved knee portion 88, and a downwardly extending leg portion 90. Throughout its length, contoured casting 80 is concavely curved from side to side in approximately a 36 degree radius (see FIGS. 8, 10 and 11), to help center and keep the patient comfortably secure in the seat. This concave curvature is maintained even through the bend at the knee portion 88. A bottom surface 92 has a linkage attachment portion 94 for fastening to a drive linkage system 100, which connects the contoured casting 80 to the base 32. A series of openings 102 are provided through contoured casting 80 for receiving securing hardware such as screws, a bolts, nails, etc. (not shown) for securing a body supporting cushion 104 (see FIGS. 1 and 2) to the casting. As with the back support cushion 52, the body support cushion 104 may be made quite thin while remaining comfortable, due to the contouring of the casting 80.

As illustrated in FIGS. 12, 13 and 14, the arm support member 42 has a support casting 110 having a pivotal connection and locking portion 112, an upwardly, forwardly-extending portion 114, and a top, cushion-supporting portion 116 to which is secured a cushion 118. The pivotal connecting and locking portion 112 is substantially circular with a centrally disposed pivotal connention opening 113, having a cutaway portion 120 that serves as part of a latching mechanism 122, together with a dowel 124 and a pivotally mounted lever 126. The cutaway portion 120 has a forward recess 128 for receiving a dowel 124 in locking arrangement with a front end 130 of the pivotal latch 126. The forward recessed 130 is positioned so that the top cushion supporting surface 116 is substantially horizontal when the arm support member 42 is in its locked, down position. A second, rearward recess 132 is provided in the cutaway portion 120 for receiving the dowel 124 to act as a stop limit for upward movement of the arm support member. The rear recess 132 is positioned sufficiently far back on the circumference of the pivotal connecting portion 120 that the weight of the arm support member 40 is beyond its center of gravity and will tend to fall backward, rather than fall forward when fully lifted.

In a preferred embodiment, an arm sling 140 (see FIGS. 1 and 2) extends from each side 142 and 144 of back support member 36, and is connected to a portion of the top cushion-supporting surface 116 of the arm support member 40. This is contrary to the teachings for dental patient arm slings in the past. The arm slings of the present invention are somewhat triangular pieces of material, the base portion of which is connected along the sides 140 or 142 of the back member, rather than at a point near the top of the back member. This facilitates greater arm retention and maintains a patient's arms closer to the body, allowing the dentist more room to operate in.

Figure 16:
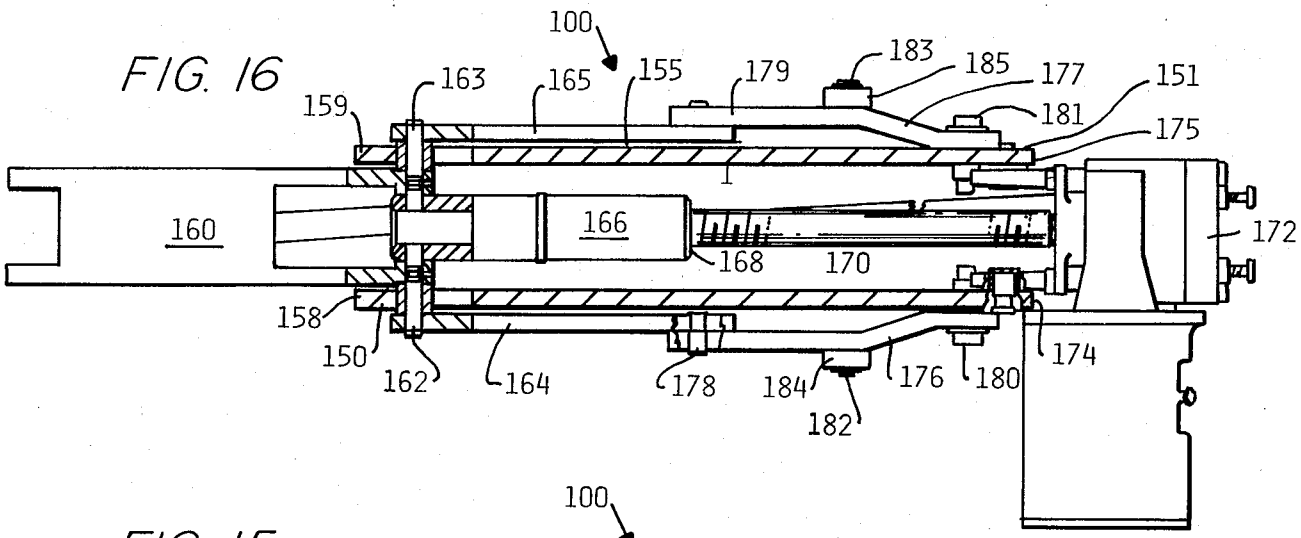
FIG. 16 is a top view of the drive linkage system of FIG. 15, taken along line 16—16 in FIG. 15.
Figure 15:
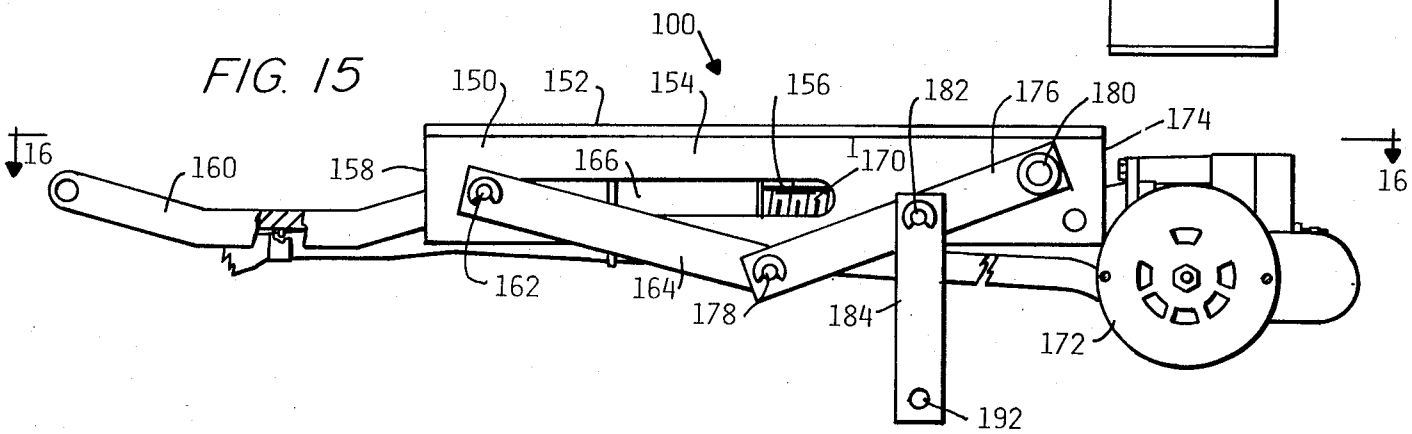
FIG. 15 is a side elevational, view of a drive linkage system for a patient support embodying the principles of the present invention.

The drive linkage system 100 may be constructed as a single linkage system or, preferably as a dual parallel linkage system as illustrated in FIGS. 15 and 16. Use of the dual linkage system offers greater support and stability to the patient support when being adjusted.

The drive linkage system 100 is attached to the bottom of contoured casting 80 by a pair of slotted, angle members 150 and 151, each having a top surface 152 and 153 with a series of openings (not shown) for receiving attachment hardware, and a downwardly extending portion 154 and 155 with a slot 156 and 157 disposed lengthwise toward a back end 158 and 159 of the angle members. A back support drive link 160 extends rearwardly from between angle members 150 and 151. Back support drive link 160 is connected via pins 162 and 163 through the slots 156 and 157 to a pair of first straight links 164 and 165 respectively, which are located on the outside of the downward portions 154 and 155 of the angle members 150 and 151 respectively. The other end of pins 162 and 163 are pivotally connected to opposite sides of a screw receiving member 166, the other end of which has a threaded opening 168 for receiving a drive screw 170. The drive screw is connected to a motor 172, which is in turn connected by suitable attachment hardware to front ends 174 and 175 of angle members 150 and 151 respectively. The other end of first straight links 164 and 165 is connected to bent links 176 and 177 (which are bent to facilitate connection to the outside of first straight links 164 and 165) at a first pivotal connection point 178 and 179, and to the angle members 150 and 151 near front ends 174 and 175 at second pivotal connecting points 180 and 181. The bent links 176 and 177 are pivotally connected at third pivotal connecting points 182 and 183 to the tops of second straight links 184 and 185. The other ends of second straight links 184 and 185 are pivotally secured to opposite sides of a base connecting member 190 at pivotal connecting points 192 and 193. Operation of the drive linkage system 100 will be described later with reference to the operation of the patient support.

Figure 17:
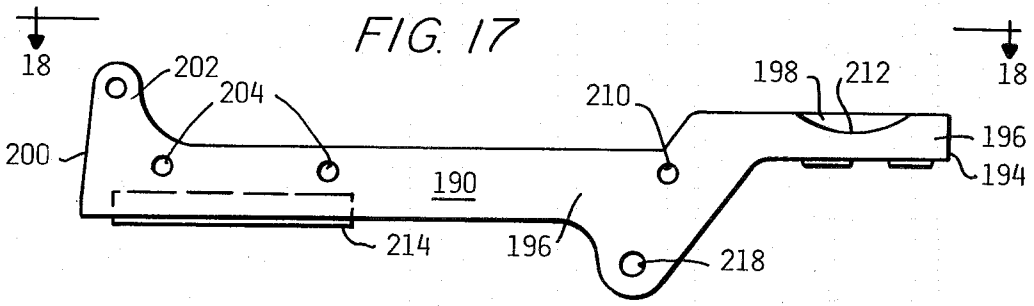
FIG. 17 is a side elevational view of a base connecting member for a patient support embodying the principles of the invention.
Figure 18:
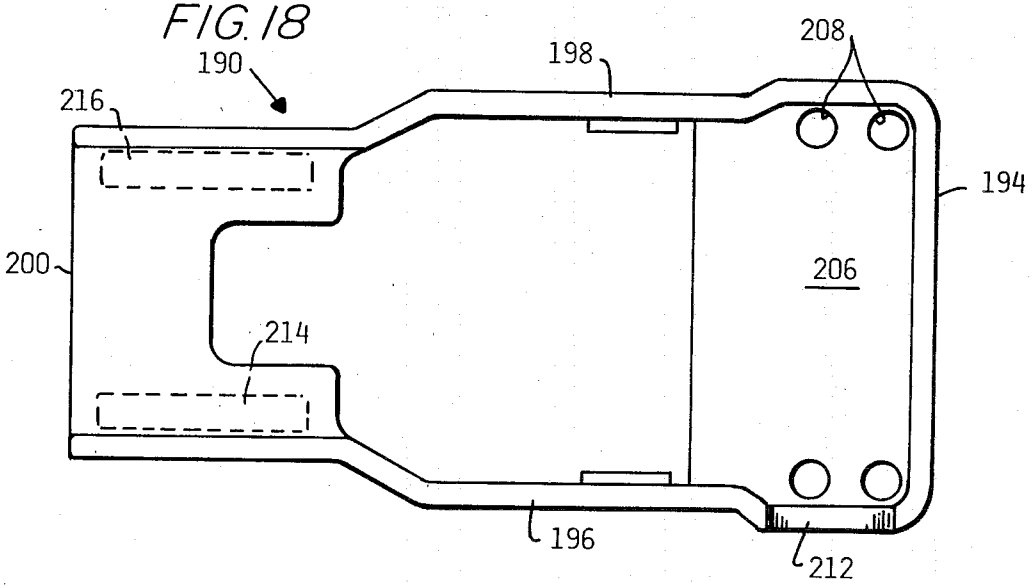
FIG. 18 is a top view of the base connecting member of FIG. 17, taken along line 18—18 in FIG. 17.

The base connecting member 190 is a frame having a front end 194, two sides 196 and 198 and a rear end 200, as illustrated in FIGS. 17 and 18. A pivotal connection portion 202 extends upwardly from the sides 196 and 198 near rear end 200 for pivotal connection of the base connecting member 190 to the bottom 92 of contoured casting 80. Sides 196 and 198 are provided with openings 204 for the attachment of an optional support arm assembly (not shown) which may swing from side to side behind the patient support to accommodate both right-handed and left-handed dentists. The support arm may be used for holding dental instruments, lights, and the like. Similarly, a plate 206 which extends across the front 194 between sides 196 and 198 may be provided with openings 208 for attachment of a side or front mounted support arm assembly. Pivotal connection openings 210 and 211 are provided respectively in sides 196 and 198 for pivotal connection points 192 and 193 respectively on second straight lengths 184 and 185. The side 196 is provided with a recessed area 212 for receiving a portion of the motor 172 or for allowing clearance for the optional support arm. A pair of slotted members 214 and 216 depend from the bottom of the base connecting member 190 and a pair of pivotal connection openings 218 and 220 are disposed through sides 196 and 198 for receiving the base extension mechanism (not shown).

OPERATION OF THE PATIENT SUPPORT

The patient support has two modes of adjustability. The entire patient support can be made to go up or go down by connection to the base extension mechanism, and the patient support may be adjusted between upright and reclined positions through operation of motor 172 and drive linkage system 100. It is the reclining and sitting-up motion which is one subject of the present invention.

The specific configuration of the drive linkage system 100 when combined with the particular point of attachment of back support member 36 to lower body support member 38 and arm support members 40 and 42 permits reclining the back member without having a patient's head change position relative to the head rest 34. As the back rest begins to recline, the linkage system causes the lower body support 38 to pivot upwardly from front end at pivotal connection area 202, causing the center of gravity of a patient sitting in the patient support to shift backward from below the buttocks when sitting, to the back between the shoulders when resting. The linkage system causes the lower body support 38 to rise only during the first portion of the reclining motion of the back support 36, just long enough to accomplish the transfer of center of gravity; afterwards the back support 36 continues to lower to its fully reclined position.

In operation, in order to recline, the motor turns the drive screw 170 clockwise so that it is received in the threaded opening 168 of the screw-receiving member 166, causing the back support drive link to move forward toward the motor by motion of pins 162 and 163 traveling through slots 156 and 157. This causes drive link receiving portion 72 on the back support casting 50 to rotate forwardly, in turn causing the backrest to recline. Simultaneously, first straight links 164 and 165 are urged forwardly causing bent links 176 and 177 to move downwardly at pivotal connecting points 178 and 179, thereby driving second straight links 184 and 185 downwardly toward the base connection member 190. Since the contoured casting 80 is pivotally connected to the base connecting member 190 only at rear mounted pivotal connection points 202, the free front end of the lower body support member 38 will rotate upwardly by the downward force of the second straight links 184 and 185. The drive linkage system 100 is oriented so that the lifting of lower body support member 38 will reach its limit in the first portion of the reclining motion of the back support member 36.

Movement of the patient support toward the upright position is accomplished by rotating the motor in a counterclockwise direction causing a reverse of the forces described in the previous paragraph.

Electronic circuitry is provided for connecting the controls 70 to the motor 172 and the base extending mechanism. Automatic positioning circuitry is provided whereby upon depressing a single switch, the patient support is adjusted to a preset reclined position. Another switch is provided along with compatible circuitry for returning the patient support to a fully upright and lowered position for patient exit. The patient support is also provided with traditional up/down and recline/sit-up control switches 70. Emergency stop circuitry is provided for promptly arresting the automatic motion of the patient support upon the movement of any of the regular (but not the automatic) control switches 70. This provides an added element of safety, the need for which has been recently felt due to the automatic positioning features of patient supports. In other words, in a situation where the operator notices the patient support converging on a piece of dental equipment in the operatory or on some other object, quickly reaching for and moving any of the standard control switches will arrest that motion in time to prevent any damage. Additional stop limit circuitry is provided for preventing the movement of the patient support if a rear mounted support arm is positioned behind the chair where it could be damaged.

To those skilled in the art to which this invention relates, many changes in construction and widely differing embodiments and applications of the invention will suggest themselves without departing from the spirit and scope of the invention. The disclosure and the descriptions herein are purely illustrative and are not intended to be in any sense limiting.

We claim:

1. A patient support, for supporting a patient thereon, and reclinable between a fully upright position and a reclined position, comprising:

a base;

a unitary lower body support, for supporting the lower body and legs of the patient, tiltably connected at a rear end thereof to said base;

a unitary upper body support, for supporting the upper body of the patient, pivotally connected to said lower body support at a pair of pivotal connection points disposed on either side of said lower and upper body supports upwardly of said rear end of said lower body support and forwardly of a lower end of said upper body support, an axis between said pivotal connection points approximating an axis between the hip joints of the patient;

a pair of arm supports, for supporting the arms of the patient, each arm support being pivotally connected at one of said pair of pivotal connection points;

a head support, for supporting the head of the patient, slidably mounted on an upper end of said upper body support; and linkage means using a single drive means for reclining said upper body support while simultaneously raising a front end of said lower body support during only a first part of the reclining of said upper body support, said simultaneous reclining and raising acting to advance the redistribution of the weight of the patient from being directed downwardly through the buttocks in the fully upright position to being directed downwardly through the chest through the back in the reclined position, thereby maintaining the oral cavity of the patient in a fixed position with respect to said head support for the entire reclining range of said patient support.

2. The improved patient support of claim 1, wherein said lower body support comprises:

a cushion-supporting casting, said casting having a downwardly bent front end, said bend commencing at approximately the middle of said casting at a point which will lie approximately adjacent to the knees of a patient sitting in said support, said casting having a concave cross-section throughout its length for centering the patient on the lower body support, and upwardly, outwardly curved pivotal connection extensions near the back for pivotal connection to said upper body support, replaceable cushion means corresponding to the shape of said casting, and releasable securing means for holding said cushion means on said casting.

3. The improved patient support of claim 2 wherein said rear end of said lower body support casting is disposed at an angle of approximately 15–20 degrees to the plane of the floor when said patient support is in a fully upright position.

4. The improved patient support of claim 1 wherein said upper body support comprises:

a cushion-supporting casting, said casting having a narrow top width which gradually widens towards its bottom, a concave cross-section except for a gradual thickening toward the bottom of said casting for providing lumbar support to a patient sitting in the patient support, and forwardly, outwardly curved pivotal connection extensions from both sides near the bottom for pivotal connection to said lower body support, replaceable cushion means corresponding to the shape of said casting, and releasable securing means for holding said cushion means on said casting.

5. The improved patient support of claim 4 wherein said upper body support casting is disposed at an angle of approximately 15–20 degrees back from vertical when said patient support is in a fully upright position.

6. The improved patient support of claim 1 wherein said arm supports each comprise:

a cushion support casting having a circular pivotal connecting portion for permitting rotational movement of said arm supports between an up position for moving said arm supports out of the way of a patient entering or exiting said patient support and a down position for retaining a patient in said patient support for operation, said circular portion being unitary with an extension portion and a cushion-supporting portion, said circular portion having an abbreviated portion defining stop limits for the pivotal motion of said arm supports, a dowell disposed to contact said stop limits set by said abbreviated portion, releasable securing means disposed to lock against said dowell when said arm supports are oriented downwardly for operation, replaceable cushion means corresponding to the shape of said cushion-supporting portion, and releasable securing means for holding said cushion means on said cushion-supporting portion.

7. The improved patient support of claim 6 wherein said cushion-supporting casting has a center of gravity disposed to urge said arm supports back when in the up position to prevent them from falling towards the down position.

8. The improved patient support of claim 6 wherein said arm supports include flexible arm slings, said arm slings having a somewhat triangular shape, the base of said triangle being connected along the respective sides of said upper body support member and the apex of said triangle being connected to said cushion support portion.

9. The improved patient support of claim 1 wherein said linkage means comprises:

a pair of slotted, angled members connected at the top in parallel to a bottom surface of the lower body support member, said slots extending lengthwise along a downwardly extending portion of said angled members, a drive motor connected between said angled members extending outwardly from their front, a drive screw operatively connected to said motor and extending backwardly between said angled members, a screw-receiving member having a threaded opening at its front end for insertion of said drive screw, said screw-receiving member being slidably disposed in said slots, an upper body support drive link connected between the back of said screw-receiving member and the bottom of said upper body support member, a first pair of parallel links pivotally connected at a back end thereof to said screw-receiving member outside said angled members, and pivotally connected at a front end thereof to the back end of a second pair of parallel links, said second pair of parallel links pivotally connected at a front end thereof to said angled members near the front end thereof, and a third pair of parallel links pivotally connected at a top end thereof to said second pair of parallel links and at a bottom end thereof to a top forward portion of said base.

10. The improved patient support of claim 1 wherein said upper body support is contoured to fit the shape of the back and has a lumbar support portion, said contouring and lumbar support cooperating with said linkage system to retain the oral cavity of a patient in fixed position with respect to said head support.

11. The improved patient support of claim 1 having a support arm extending backwardly from the rear of the base for supporting equipment to be used by the dentist.

12. The improved patient support of claim 1 having automatic circuit means to prevent reclining of the upper body support member when said support arm is in a position where it could be damaged by the reclining of said upper body support member.

13. A drive linkage system for a patient support having an upper body support member pivotally connected to a lower body support member which is pivotally connected near a back end thereof to the top back portion of a base, comprising:

a pair of slotted, angled members connected at the top in parallel to a bottom surface of the lower body support member, said slots extending lengthwise along a downwardly extending portion of said angled members, a drive motor connected between said angled members extending outwardly from their front, a drive screw operatively connected to said motor and extending backwardly between said angled members, a screw-receiving member having a threaded opening at its front end for insertion of said drive screw, said screw-receiving member being slidably disposed in said slots, an upper body support drive link connected between the back of said screw-receiving member and the bottom of said upper body support member, a first pair of parallel links pivotally connected at a back end thereof to said screw-receiving member outside said angled members, and pivotally connected at a front end thereof to the back end of a second pair of parallel links, said second pair of parallel links pivotally connected at a front end thereof to said angled members near the front end thereof, and a third pair of parallel links pivotally connected at a top end thereof to said second pair of parallel links and at a bottom end thereof to a top forward portion of said base, said drive linkage system operating to simultaneously raise the front of said lower body support member during only the first portion of the reclining of said upper body support member.

14. The drive linkage system of claim 13 wherein said upper body support member is pivotally connected to said lower body support member at a point approximating the hip of a patient sitting in said patient support.

15. The linkage system of claim 14 wherein said pivotal connection point is approximately five inches forward of the bottom of said upper body support member and five inches above the back end of said lower body support member.

* * * * *